US009730490B2

(12) United States Patent
Farris et al.

(10) Patent No.: US 9,730,490 B2
(45) Date of Patent: Aug. 15, 2017

(54) UPPER FOR AN ARTICLE OF FOOTWEAR WITH AUXETIC CONFIGURATION

(71) Applicant: NIKE, Inc., Beaverton, OR (US)

(72) Inventors: Bryan N. Farris, North Plains, OR (US); Petre Gheorghian, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 36 days.

(21) Appl. No.: 14/817,501

(22) Filed: Aug. 4, 2015

(65) Prior Publication Data

US 2017/0035147 A1 Feb. 9, 2017

(51) Int. Cl.
*A43B 23/02* (2006.01)

(52) U.S. Cl.
CPC ..... *A43B 23/027* (2013.01); *A43B 23/0205* (2013.01); *A43B 23/026* (2013.01); *A43B 23/0245* (2013.01); *A43B 23/0265* (2013.01)

(58) Field of Classification Search
CPC .. A43B 23/026; A43B 23/0265; A43B 23/027
USPC ..... 36/3 A, 45, 97
See application file for complete search history.

(56) References Cited

U.S. PATENT DOCUMENTS 4,265,032 A * 5/1981 Levine ..... A43B 3/107 36/11.5
7,047,668 B2 5/2006 Burris et al.
7,171,767 B2 * 2/2007 Hatfield ..... A43B 3/0057 36/102
8,333,021 B2 * 12/2012 Johnson ..... A43B 3/14 36/11
2008/0011021 A1 1/2008 Starbuck et al.
2009/0183392 A1 7/2009 Shane
2011/0302810 A1 12/2011 Borel et al.
2014/0053312 A1 2/2014 Nordstrom et al.
2014/0059734 A1 3/2014 Toronjo
2014/0101816 A1 * 4/2014 Toronjo ..... A41D 31/0011 2/69
2014/0109286 A1 * 4/2014 Blakely ..... A41D 31/02 2/69
2014/0245637 A1 9/2014 Fahmi et al.
2014/0260281 A1 9/2014 Innes
2014/0373288 A1 12/2014 Greene et al.
2015/0245686 A1 9/2015 Cross

FOREIGN PATENT DOCUMENTS

WO 2010125397 A1 11/2010
WO 2015019451 A1 12/2015

OTHER PUBLICATIONS

PCT International Search Report and Written Opinion, for International Application No. PCT/US2016/042752, Dated Oct. 7, 2016.

* cited by examiner

*Primary Examiner* — Ted Kavanaugh
(74) *Attorney, Agent, or Firm* — Quinn IP Law

(57) ABSTRACT

An article of footwear includes an upper with openings arranged in an auxetic configuration. The upper includes at least two openings that differ in size. Regions of the upper with larger openings may expand more than regions of the upper with smaller openings.

10 Claims, 10 Drawing Sheets

UPPER FOR AN ARTICLE OF FOOTWEAR WITH AUXETIC CONFIGURATION

BACKGROUND

The present embodiments relate generally to articles of footwear, and in particular to articles of footwear with uppers and sole structures.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY

In one aspect, an upper for an article of footwear includes a first region and a second region of the upper, where the second region is different from the first region. The upper also includes a first set of openings arranged in an auxetic pattern in the first region, the first region changing from a first neutral state to a first auxetically expanded state when tension is applied along a first axis parallel with the first region. The upper also includes a second set of openings arranged in an auxetic pattern in the second region, the second region changing from a second neutral state to a second auxetically expanded state when tension is applied along a second axis parallel with the first region. The first set of openings has a first opening with a first opening boundary. The second set of openings has a second opening with a second opening boundary and the first opening boundary has a greater perimeter length than the second opening boundary when the first region is in the first neutral state and when the second region is in the second neutral state.

In another aspect, an upper for an article of footwear includes a first region of the upper having a first elasticity and a second region of the upper having a second elasticity, where the second elasticity is different from the first elasticity. The upper also includes a first set of openings arranged in an auxetic pattern in the first region, the first region changing from a first neutral state to a first auxetically expanded state when tension is applied along a first axis parallel with the first region. The upper also includes a second set of openings arranged in an auxetic pattern in the second region, the second region changing from a second neutral state to a second auxetically expanded state when tension is applied along a second axis parallel with the first region.

In another aspect, an upper for an article of footwear includes an exterior surface and an interior surface that bounds an interior cavity of the upper, the interior cavity being configured to receive a foot. A portion of the upper has an outer surface and an inner surface, where the outer surface comprises part of the exterior surface of the upper and where the inner surface comprises part of the interior surface of the upper. The portion has a uniform material composition. The upper includes a set of openings arranged in an auxetic pattern in the portion. The portion changes from a neutral state to an auxetically expanded state when tension is applied along a first axis parallel with the portion.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
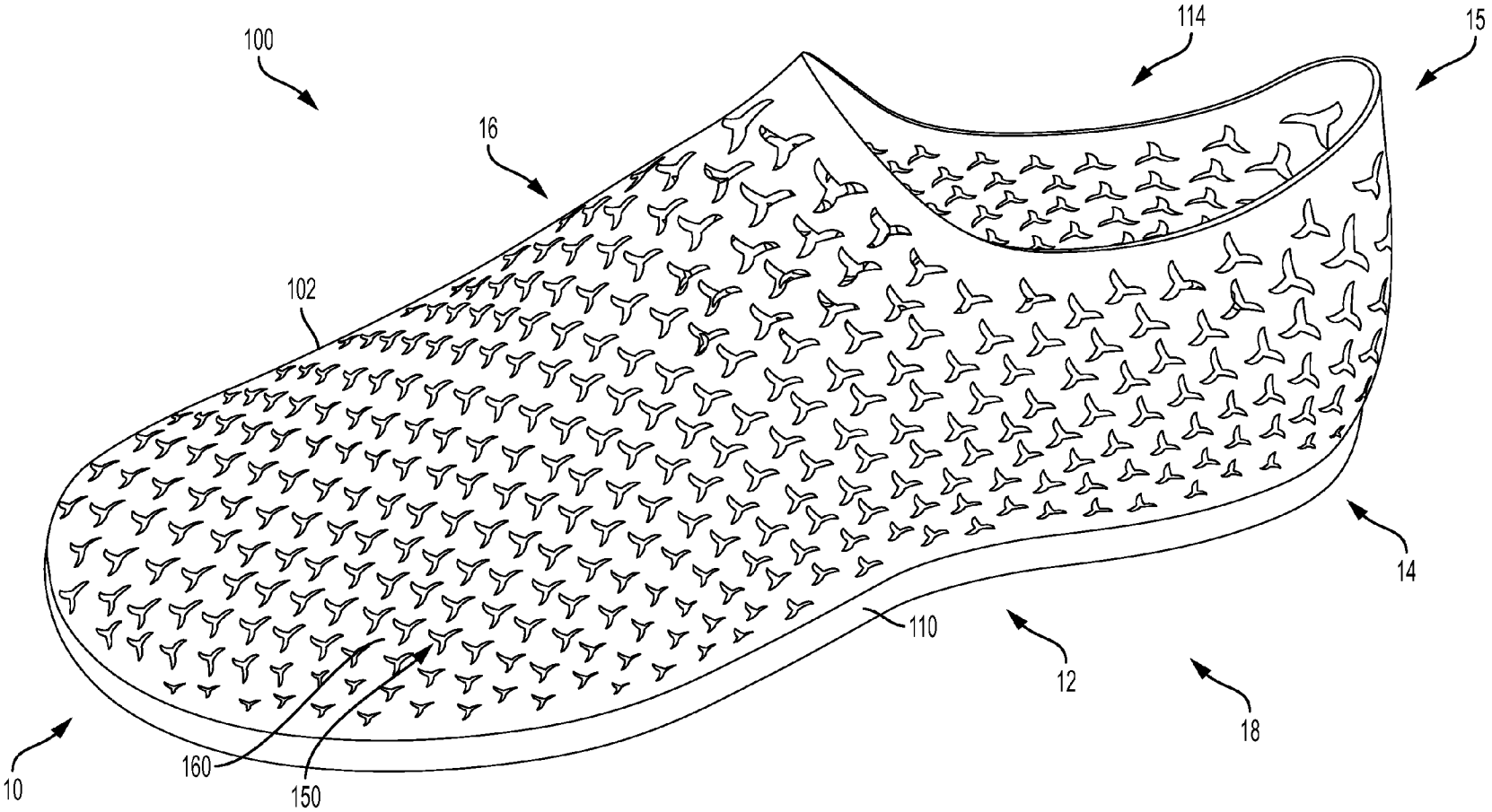
FIG. 1 is a medial isometric view of an embodiment of an article of footwear including an upper with an auxetic configuration.

FIG. 1 is an isometric view of an embodiment of article of footwear 100. In the exemplary embodiment, article of footwear 100 has the form of an athletic shoe. However, in other embodiments, the provisions discussed herein for article of footwear 100 could be incorporated into various other kinds of footwear including, but not limited to, basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for article of footwear 100 could be incorporated into various other kinds of non-sports-related footwear, including, but not limited to, slippers, sandals, high-heeled footwear, and loafers.

For purposes of clarity, the following detailed description discusses the features of article of footwear 100, also referred to simply as article 100. However, it will be understood that other embodiments may incorporate a corresponding article of footwear (e.g., a left article of footwear when article 100 is a right article of footwear) that may share some, and possibly all, of the features of article 100 described herein and shown in the figures.

The embodiments may be characterized by various directional adjectives and reference portions. These directions and reference portions may facilitate in describing the portions of an article of footwear. Moreover, these directions and reference portions may also be used in describing subcomponents of an article of footwear (e.g., directions and/or portions of an inner sole component, a midsole component, an outer sole component, an upper, or any other components).

For consistency and convenience, directional adjectives are employed throughout this detailed description corresponding to the illustrated embodiments. The term "longitudinal" as used throughout this detailed description and in the claims refers to a direction extending a length of a component (e.g., an upper or sole component). A longitudinal direction may extend along a longitudinal axis, which itself extends between a forefoot portion and heel portion of the component. Also, the term "lateral" as used throughout this detailed description and in the claims refers to a direction extending along a width of a component. A lateral direction may extend along a lateral axis, which itself extends between a medial side and lateral side of a component. Furthermore, the term "vertical" as used throughout this detailed description and in the claims refers to a direction extending along a vertical axis, which itself is generally perpendicular to a lateral axis and longitudinal axis. For example, in cases where an article is planted flat on a ground surface, a vertical direction may extend from the ground surface upward. Additionally, the term "inner" refers to a portion of an article disposed closer to an interior of an article, or closer to a foot when the article is worn. Likewise, the term "outer" refers to a portion of an article disposed further from the interior of the article or from the foot. Thus, for example, the inner surface of a component is disposed closer to an interior of the article than the outer surface of the component. This detailed description makes use of these directional adjectives in describing an article and various components of the article, including an upper and a sole structure.

Article 100 may include upper 102 and sole structure 110. In some embodiments, sole structure 110 may be configured to provide traction for article 100. In addition to providing traction, sole structure 110 may attenuate ground reaction forces when compressed between the foot and the ground during walking, running, or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to, natural turf, synthetic turf, dirt, hardwood flooring, as well as other surfaces.

Sole structure 110 is secured to upper 102 and extends between the foot and the ground when article 100 is worn. In different embodiments, a sole structure may include different components. For example, some sole structures may include an inner sole component, a midsole component, and/or an outer sole component (i.e. an outsole). In some cases, one or more of these components may be optional.

In different embodiments, sole structure 110 may generally incorporate various provisions. For example, in one embodiment, one or more components of a sole structure, such as a midsole component, may be formed from a polymer foam material that attenuates ground reaction forces (i.e., provides cushioning) during walking, running, and other ambulatory activities. In various embodiments, components of a sole structure may also include fluid-filled chambers, plates, moderators, or other elements that further attenuate forces, enhance stability, or influence the motions of the foot, for example.

Upper 102 could have a variety of different configurations. In particular, upper 102 may have any design, shape, size, and/or color. For example, in embodiments where article 100 is a basketball shoe, upper 102 could be a high-top upper that is shaped to provide high support on an ankle. In embodiments where article 100 is a running shoe, upper 102 could be a low-top upper.

In some embodiments, upper 102 includes opening 114 that provides entry for the foot into an interior cavity of upper 102. In some embodiments, upper 102 may also include a tongue (not shown) that provides cushioning and support across the instep of the foot. Some embodiments may include fastening provisions, including, but not limited to, laces, cables, straps, buttons, zippers as well as any other provisions known in the art for fastening articles.

Some embodiments may include uppers that extend beneath the foot, thereby providing 360-degree coverage at some regions of the foot. However, other embodiments need not include uppers that extend beneath the foot. In other embodiments, for example, an upper could have a lower periphery joined with a sole structure and/or sock liner.

Upper 102 may be characterized by a number of different regions or portions. For example, upper 102 could include a forefoot portion, midfoot portion, heel portion, and an ankle portion. Moreover, other components of article 100 could likewise comprise corresponding portions. Referring to FIG. 1, upper 102 may be divided into forefoot portion 10, midfoot portion 12, and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. Article 100 may also include ankle portion 15 (which may also be referred to as a cuff portion). In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12, heel portion 14, and ankle portion 15.

In different embodiments, upper 102 and sole structure 110 could be joined in various ways. In some embodiments, upper 102 could be joined to sole structure 110, e.g., using an adhesive or by stitching. Moreover, these components may be joined using any methods known in the art for joining sole components with uppers, including various lasting techniques and provisions (e.g., board lasting, slip lasting, etc.). In some cases, the joining of an upper and a sole structure could be accomplished using any known methods for bonding components of articles of footwear, including, but not limited to, adhesives, films, tapes, staples, stitching, or other methods.

Embodiments can include provisions to facilitate expansion and/or adaptability of an upper to improve fit and to modify support during various motions of the foot. In some embodiments, an upper may be configured with auxetic provisions. In particular, one or more components of the upper may be capable of undergoing auxetic motions (e.g., expansion and/or contraction).

Figure 2:
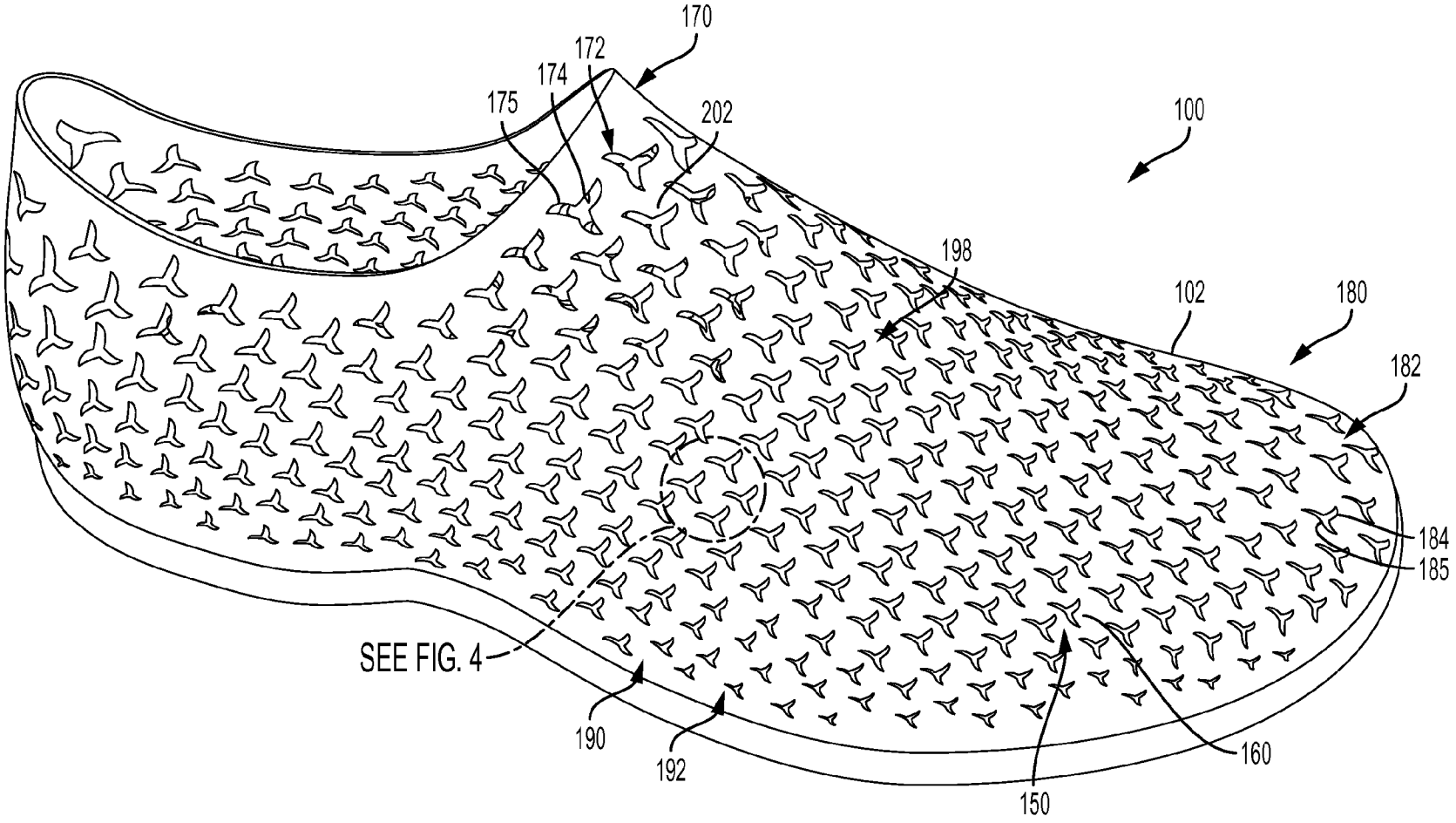
FIG. 2 is a lateral isometric view of an embodiment of an article of footwear including an upper with an auxetic configuration.
Figure 3:
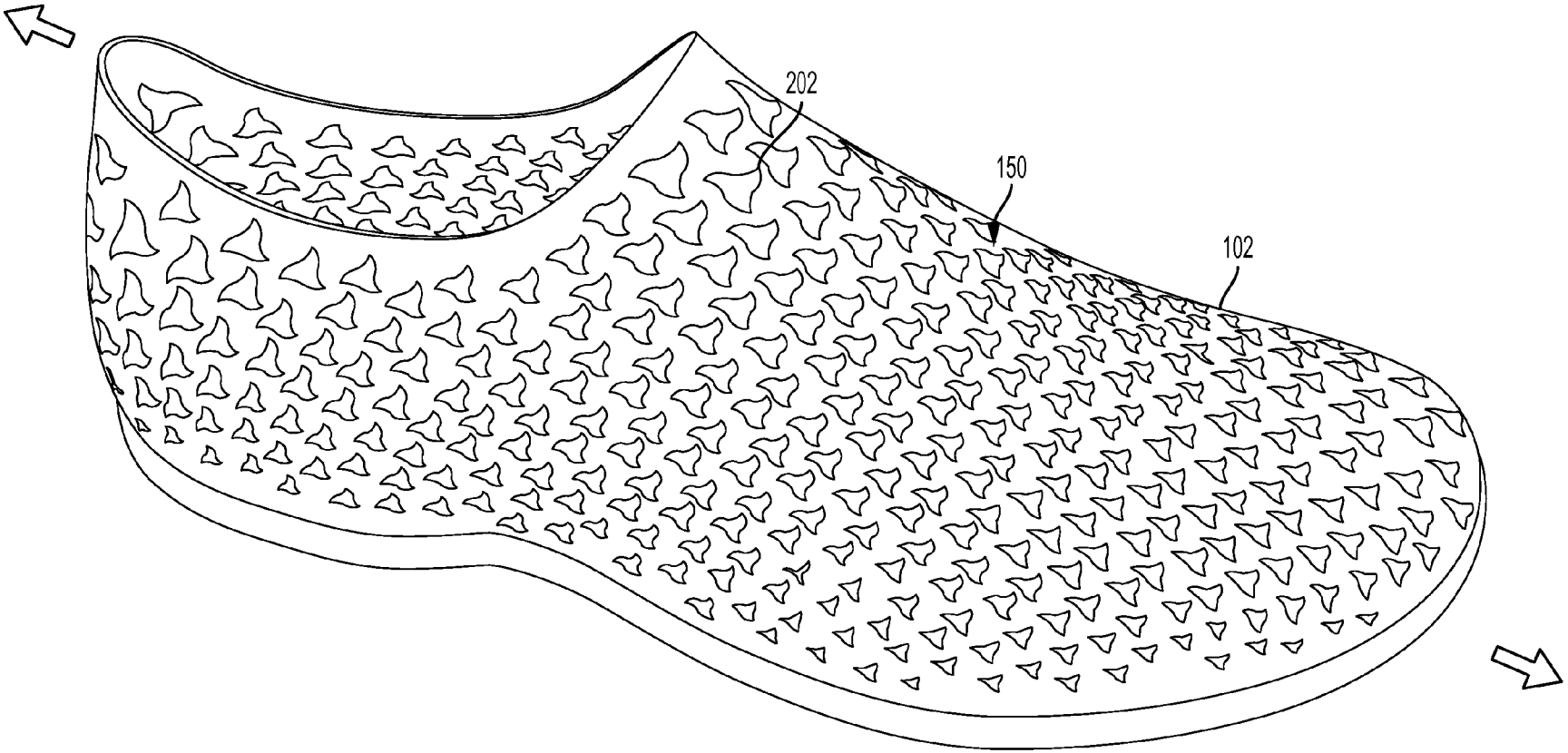
FIG. 3 is a lateral isometric view of the article of FIG. 2 undergoing auxetic expansion.

Upper 102, as shown in FIGS. 1-3 and as described further in detail below, has an auxetic structure or configuration. Auxetic structures or auxetic materials have a negative Poisson's ratio, such that when they are under tension in a first direction, their dimensions increase both in the first direction and in a second direction orthogonal or perpendicular to the first direction.

Embodiments may make use of any of the auxetic patterns and/or structures disclosed in Cross, U.S. patent application Ser. No. 14/030,002, filed Sep. 18, 2013 and entitled "Auxetic Structures and Footwear with Soles Having Auxetic Structures" (the "Auxetic Structures application"), the entirety of which is hereby incorporated by reference. Some embodiments could also utilize any of the auxetic patterns and/or opening (or hole) configurations that are disclosed in Cross, U.S. patent application Ser. No. 14/643,121, filed Mar. 10, 2015, titled "Sole Structure with Holes Arranged in Auxetic Configuration," the entirety of which is herein incorporated by reference.

As seen in FIGS. 1-2, upper 102 may include a plurality of openings 150. As used herein, the term "opening" refers to any hollowed area or recessed area in a component. In some cases, an opening may be a through hole, in which the opening extends between two opposing surfaces of a component. In other cases, an opening may be a blind hole, in which the opening may not extend through the entire thickness of the component and may therefore only be open on one side. Moreover, as discussed in further detail below, a component may utilize a combination of through holes and blind holes. Furthermore, the term "opening" may be used interchangeably in some cases with "hole", "aperture," or "recess."

In regions including one or more openings, upper 102 may be comprised of plurality of upper portions 160, or simply upper portions 160. Specifically, upper portions 160 comprise the material portions of upper 102 that extend between plurality of openings 150. Thus, it may be understood that each opening may be surrounded by a plurality of upper portions, such that the boundary of each opening may be defined by the edges of the upper portions.

Figure 4:
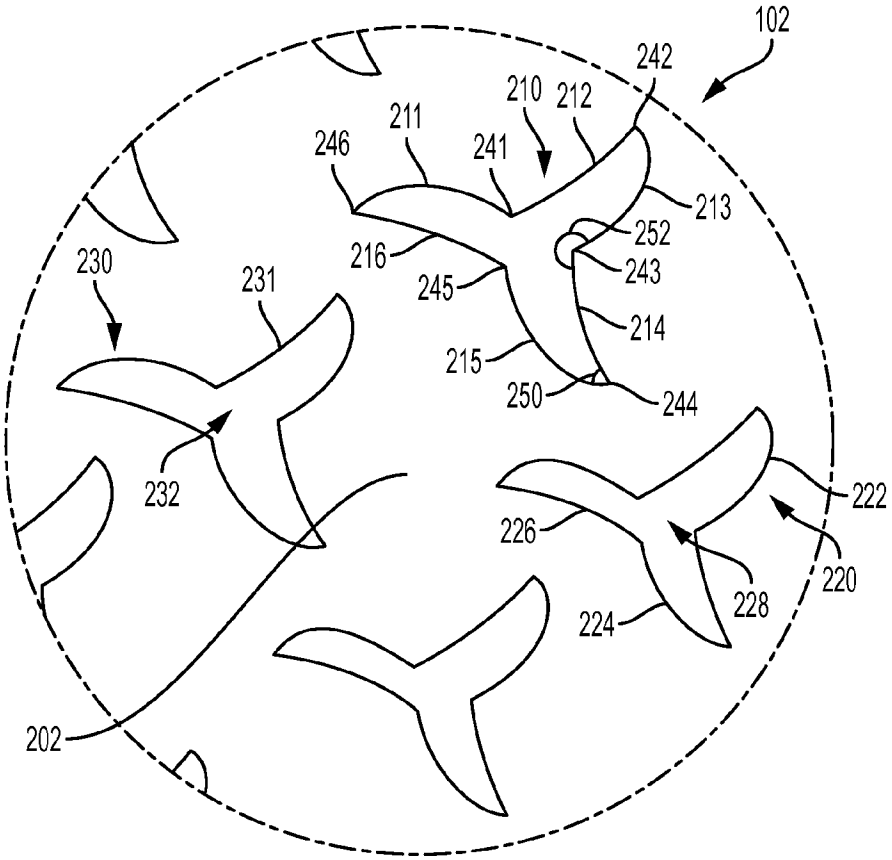
FIG. 4 is an enlarged view of a portion of the upper in FIG. 2.

FIG. 4 is an enlarged view of a region of upper 102 that is comprised of several openings, including first opening 210, second opening 220, and third opening 230. The following discussion describes some of the attributes of these three particular openings; however, it may be appreciated that the principles described here may apply to any of the openings in plurality of openings 150 of upper 102.

In different embodiments, an opening may be comprised of one or more edges that are connected at vertices. In some embodiments, an opening could comprise six edges connected by six vertices. For example, first opening 210 includes six edges connected to one another by six vertices. Specifically, first opening 210 includes first edge 211 that is joined to second edge 212 by first vertex 241. Second edge 212 is joined to third edge 213 by second vertex 242. Third edge 213 is joined to fourth edge 214 by third vertex 243. Fourth edge 214 is joined to fifth edge 215 by fourth vertex 244. Fifth edge 215 is joined to sixth edge 216 by fifth vertex 245. Finally, sixth edge 216 is joined back to first edge 211 by sixth vertex 246. Thus, these edges are joined together to form a closed contour that bounds first opening 210.

It may be appreciated that the edges for each opening discussed herein may be considered as forming part of the boundary of the opening. The edges, though bounding the opening, may be considered as part of an adjacent portion of upper material that bounds an adjacent void of material.

Adjacent edges within each opening may form an interior angle (an interior vertex angle), which is an angle measured at a vertex between two edges as measured from within an interior of the opening. In some embodiments, each opening may be configured with a combination of interior vertex angles having angles less than 90 degrees and having angles greater than 90 degrees. For example, first opening 210 includes first interior vertex angle 250 that is less than 90 degrees and second interior vertex angle 252 that is greater than ninety degrees. In the embodiment of FIG. 4, second interior vertex angle 252 is greater than 180 degrees. Moreover, the interior vertex angles may alternate within first opening 210 so that interior vertex angles at second vertex 242, fourth vertex 244, and sixth vertex 246 are less than 90 degrees and interior vertex angles at first vertex 241, third vertex 243, and fifth vertex 245 are greater than 90 degrees. In some cases, the interior vertex angles at first vertex 241, third vertex 243, and fifth vertex 245 are greater than 180 degrees.

In different embodiments, the geometry of one or more edges could vary. In some embodiments, an edge could have an approximately straight geometry. In other embodiments, an edge could have a curved or contoured geometry. In the embodiments of FIGS. 1-4, the edges of the openings all have curved or contoured geometries (i.e., non-linear).

The edges of each opening may be arranged into pairs that form arm-like extensions. For example, second opening 220 includes six edges similar to first opening 210, which are arranged into pairs that form arm portions. Specifically, second opening 220 includes first arm portion 222, second arm portion 224, and third arm portion 226, which are each connected to central portion 228 of second opening 220.

The geometry of each opening may be defined by the geometry and arrangement of its individual edges. Referring to FIG. 4, the openings of the illustrated embodiment are seen to have an approximate symmetry with respect to rotations of 120 degrees. In some embodiments, the openings may have a geometry that may be characterized as pinwheel-like. The geometry may also be characterized as a tristar geometry (i.e., a geometric star with three arms or outer vertices), or an isotaxal star triangle.

It may be appreciated that the geometries for each opening described above are only intended to be exemplary and in other embodiments any other opening geometries that may form an auxetic pattern or tiling on an upper could be used.

The geometry of one or more upper portions (e.g., portions of the upper within which openings are formed) could also vary. It may be understood that the geometry of an upper portion may be determined by the geometry of the openings in an auxetic pattern, and vice versa. In some embodiments, slight variations in the size, position, and/or relative arrangement of two or more openings may provide variable geometries for adjacent upper portions.

Of course, the features of the openings shown in FIG. 4 (e.g., first opening 210) may be shared by any other openings disposed in upper 102. In some embodiments, each opening in plurality of openings 150 may have similar shapes or geometries, though in some cases some openings may differ in size as discussed in further detail below.

Referring now to FIG. 3, upper 102 may be seen to undergo auxetic expansion as tension is applied longitudinally across upper 102. During auxetic expansion, plurality of openings 150 may tend to expand uniformly along directions parallel to a surface of upper 102. Specifically, during auxetic expansion, each arm portion of an opening tends to expand in width (e.g., each arm portion "opens up"). As the arm portion opens up, the interior vertex angles associated with the two edges of the arm portion increase while the interior vertex angles at the base of the arm portion decrease. Further details about how the interior vertex angles in an opening with six edges changes under auxetic expansion are discussed in further detail in the Auxetic Structures application.

As each opening expands, the area enclosed by a boundary of the opening (e.g., the area of the opening) also increases. As the surface area of the openings increases, the total surface area of upper 102 (including the surface area of the upper portions and the area of the openings) is increased, allowing the upper to stretch and better conform to a foot. This may be contrasted with non-auxetic materials where applying tension across the material might stretch the material in one direction along the surface of the material and simultaneously contract the material in a direction along the surface that is perpendicular to the direction of tensioning.

Referring to FIGS. 2 and 3, which depict upper 102 in a neutral state and an auxetically expanded state, it is clear that opening 202 (for example) has expanded uniformly in area, with each of its arm portions expanding (or widening) by an equivalent percentage of its non-tensioned size. Moreover, the remaining openings of plurality of openings 150 have expanded in a similar manner to opening 202 under auxetic expansion.

Each opening may be characterized by an opening boundary, which is comprised of two or more edges. Furthermore, each opening boundary has a perimeter length. As an example, third opening 230 (see FIG. 4) has opening boundary 231 that is comprised of six edges. Moreover, opening boundary 231 may have an associated perimeter length that is the sum of the lengths of each of its six edges. Opening boundary 231 may further enclose opening area 232.

Embodiments may include provisions for selectively modifying the flexibility of different regions or portions of an upper. In some embodiments, the sizes of openings can be varied across different regions to provide variation in the flexibility of those different regions. For example, a first region having larger openings (in a neutral state) may be more flexible than a second region having smaller openings (in a neutral state). This may occur because the first region may undergo a greater degree of auxetic expansion than the first region under a common tension across the upper.

Referring now to FIG. 2, upper 102 may be configured with at least two different regions having different opening sizes. Specifically, upper 102 includes throat region 170 and forefoot region 180. Throat region 170 includes first set of openings 172 having opening sizes that are generally larger than the sizes of openings in second set of openings 182 within forefoot region 180. For example, first opening 174 in throat region 170 has first opening boundary 175 with a first perimeter length and second opening 184 in forefoot region 180 has opening boundary 185 with a second perimeter length. Here, the second perimeter length is less than the first perimeter length. Moreover, the opening area enclosed by first opening boundary 175 is greater than the opening area enclosed by second opening boundary 185.

Similarly, arch region 190 (within midfoot portion 12 of upper 102) may also include third set of openings 192. These openings may have opening sizes that are generally smaller than the opening sizes in throat region 170 and may or may not differ from the opening sizes in forefoot region 180.

Figure 5:
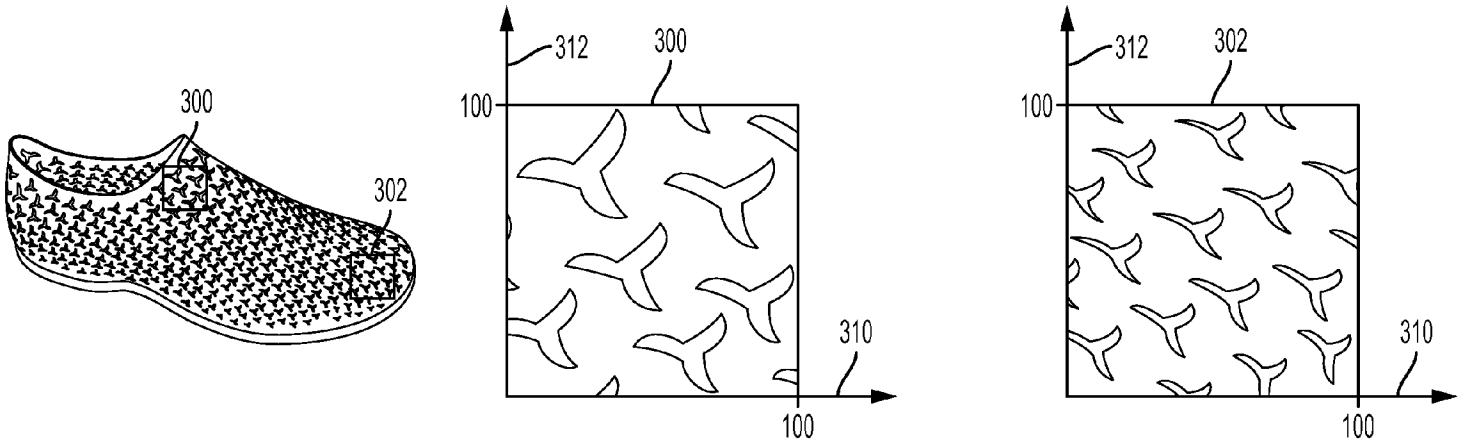
FIG. 5 is a schematic view of an embodiment of an article of footwear including enlarged views of two different portions.
Figure 6:
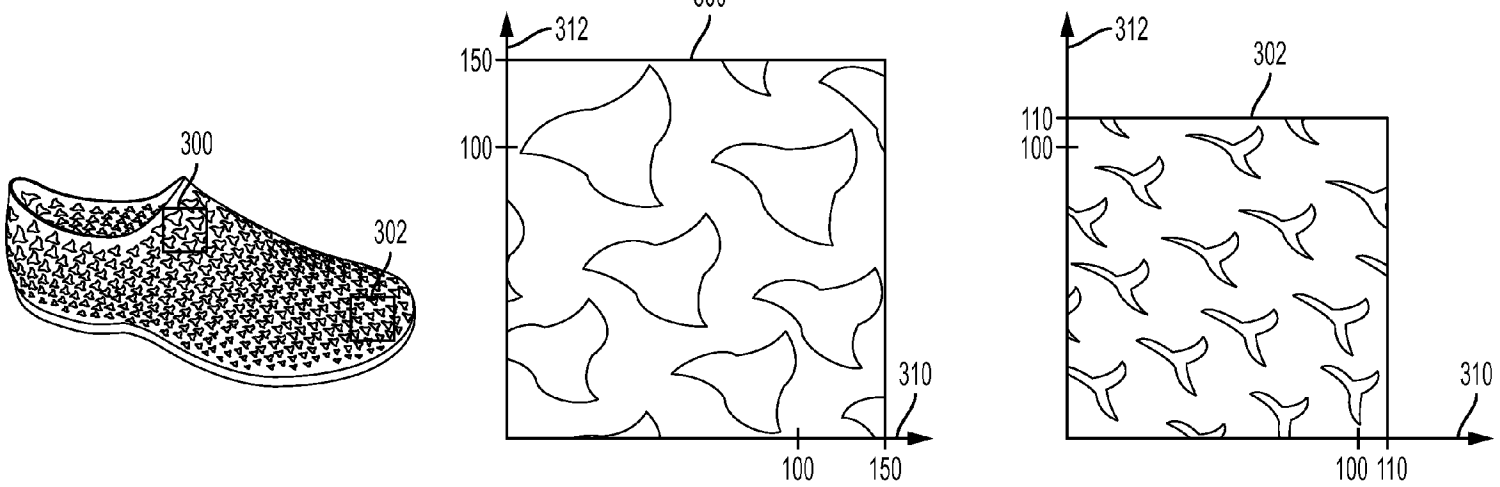
FIG. 6 is a schematic view of an embodiment of an article of footwear including enlarged views of two different portions.

As discussed previously, regions with larger opening sizes may tend to expand more, or stretch/flex more, than regions with relatively smaller opening sizes even when both regions are exposed to the same amount of tension. Referring now to FIG. 5, two exemplary regions, first region 300 and second region 302 are depicted schematically with enlarged views during a neutral state (i.e., a non-tensioned state). FIG. 6 schematically depicts the same two regions when tension is applied. In each case, the region changes from a neutral state to an "auxetically expanded state."

As seen by comparing FIGS. 5 and 6, first region 300 expands more than second region 302. Specifically, along dimension 310 and perpendicular dimension 312 (which may be seen to be directed along perpendicular axes of the regions), first region 300 increases by 50% (e.g., from 100% to 150%) during auxetic expansion. In contrast, along dimension 310 and perpendicular dimension 312, second region 302 increases by only 10% (e.g., from 100% to 110%) during auxetic expansion. In other words, first region 300 flexes or stretches by a greater amount than second region 302 due to the larger opening sizes in first region 300.

The area of first region 300 is seen to expand more than the area of second region 302. Specifically, first region 300 has a first region boundary that encloses a neutral first region area in the first neutral state and an expanded first region area in the first auxetically expanded state. Likewise, second region 302 has a second region boundary that encloses a neutral second region area in the second neutral state and an expanded second region area in the second auxetically expanded state. A ratio of the expanded first region area to the neutral first region area is greater than a ratio of the expanded second region area to the neutral second region area.

It may be appreciated that the difference in opening sizes in throat region 170 and forefoot region 180 may likewise result in different amounts of stretch or expansion under tension. Likewise, if the opening sizes in an intermediate region (e.g., vamp region 198 as shown in FIG. 2) have sizes between the openings and throat region 170 and the openings in forefoot region 180, then the intermediate region may tend to expand to a lesser degree than throat region 170 and to a greater degree than forefoot region 180.

It may be advantageous to use larger openings in regions where increased flexibility is desired, such as the throat opening and along some portions of the heel. It may also be advantageous to use smaller openings in regions where increased strength and support are desired, which may be achieved in part by limiting the stretch and flexibility of the upper material. Thus, smaller openings may be used in the toe and/or forefoot regions in some cases, to improve support to the forefoot during planting, during turning, or during other motions where increased forefoot support is desired. Likewise, smaller openings may be used in the arch regions (e.g., the lateral side of the arch region and/or the medial side of the arch region) of the foot to enhance the support provided to the arch of a foot.

Figure 7:
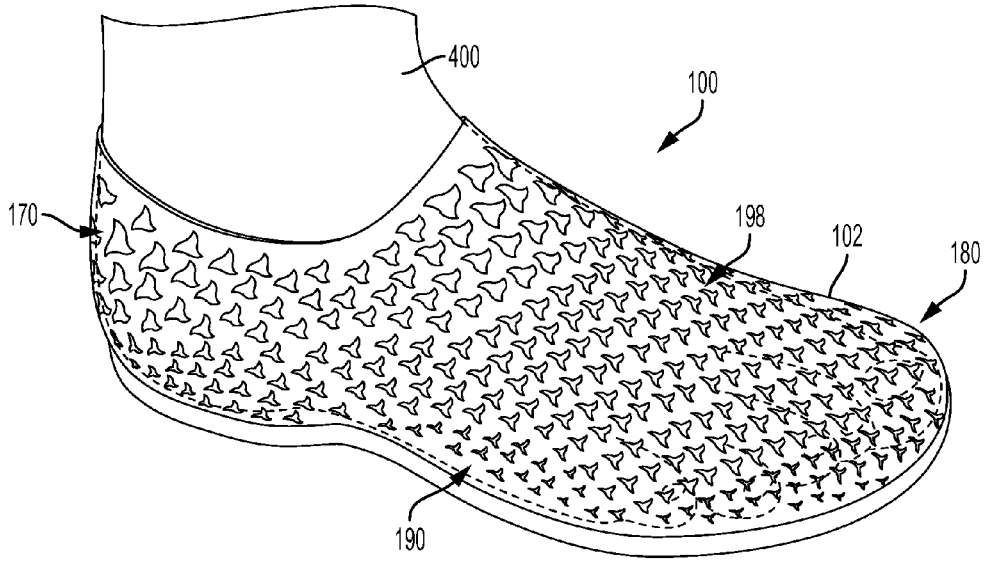
FIG. 7 is an isometric view of an embodiment of a foot inserted into the article of FIG. 2.

FIG. 7 is an isometric view of an embodiment of article 100 with foot 400 inserted into upper 102. As seen in FIG. 7, upper 102 is stretched to accommodate foot 400. Moreover, throat region 170 is seen to expand around foot 400 near the ankle and heel to more easily accommodate foot 400 within opening 114 (see FIG. 1). Upper 102 also stretches to accommodate the midfoot and forefoot of foot 400, though vamp region 198 may expand less than throat region 170, while forefoot region 180 and arch region 190 may expand very little in accommodating the foot in order to maximize support in those regions.

Figure 8:
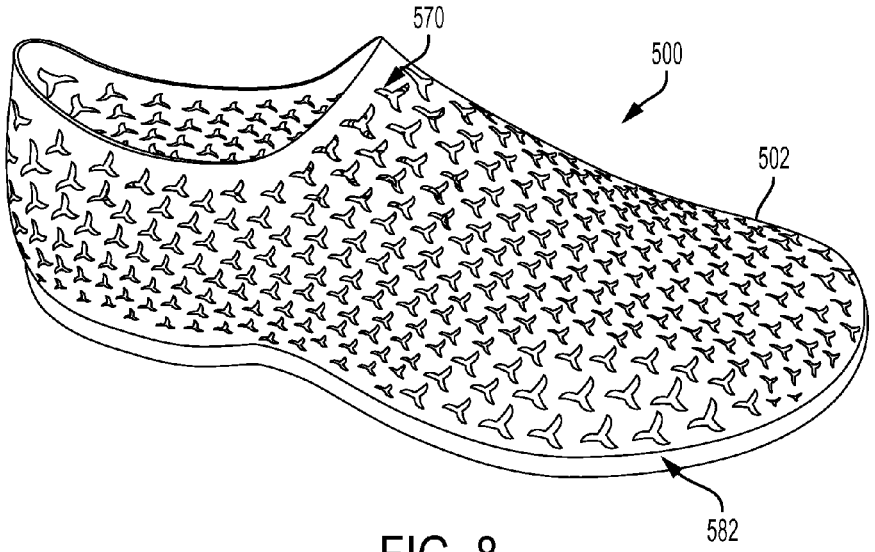
FIG. 8 is an isometric view of another embodiment of an article of footwear with an auxetic upper.
Figure 9:
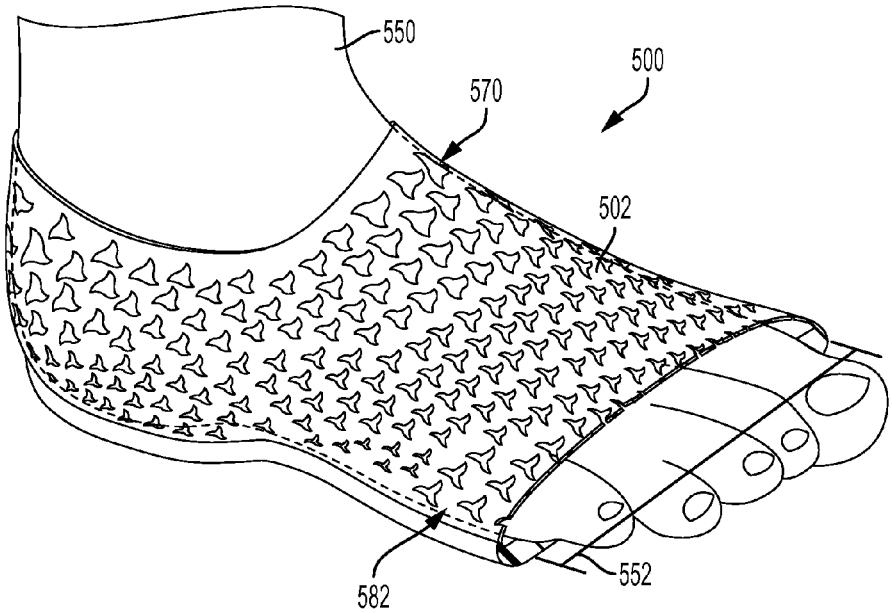
FIG. 9 is an isometric view of an embodiment of the article of FIG. 8 expanding when a foot with a first width is inserted into the upper.
Figure 10:
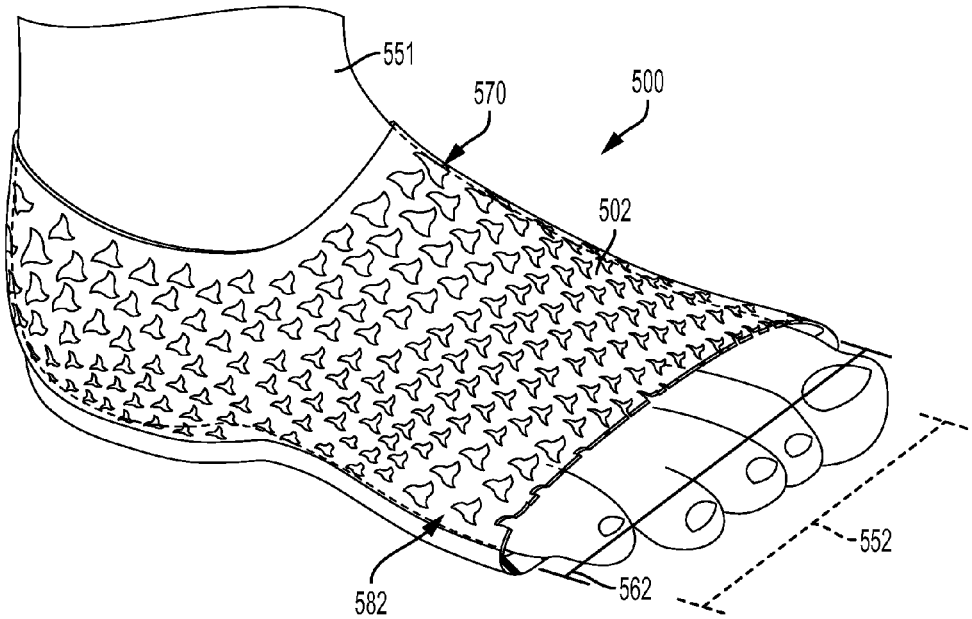
FIG. 10 is an isometric view of an embodiment of the article of FIG. 8 expanding when a foot with a second width is inserted into the upper.

In some embodiments, relatively larger openings may be positioned in the medial and/or lateral sides of the forefoot portion of an upper so that the upper can expand to accommodate different foot widths. FIG. 8 illustrates an embodiment of an article 500 with upper 502 that includes larger openings in a throat region 570 and in a lateral forefoot region 582. In some embodiments, a medial forefoot region (not shown in FIGS. 8-10) may also include larger openings. The relatively larger opening sizes in throat region 570 provides increased flexibility around the throat opening, as discussed above. In addition, increased opening sides (relative to the opening sizes in other regions of upper 502) provides increased flexibility along the sides of the forefoot portion of upper 502, which may allow upper 502 to more easily accommodate feet of different widths. For example, FIG. 9 illustrates a schematic isometric view of upper 502 stretching to fit a foot 550 with a first width 552 (e.g., a foot that might normally fit best in a shoe with a 'normal' sized width), while FIG. 10 illustrates a schematic isometric view of upper 502 stretching to fit a foot 551 with a second width 562 (e.g., a foot that might normally fit best in a shoe with a 'wide' sized width) that is greater than first width 552. For purposes of comparison, first width 552 is also shown in FIG. 10 alongside second width 562. This configuration of upper 502 allows for a single article capable of stretching to fit feet of different widths rather than requiring the manufacturing of uppers with distinct widths for the same footwear size (i.e., footwear length).

In the embodiments depicted in FIGS. 1-10, an auxetic upper is configured as a single layer of material. In particular, the upper comprises a single monolithic or uniform material composition, also referred to as a uniform material construction, comprising a single layer that extends from the inner most surface of the upper to the outermost surface of the upper. In other words, when inserted into the upper a foot may contact an inner surface of the single layer and the outer surface of the single layer may be exposed on the exterior of the article. For example, in FIG. 11, upper 602 of article 600 has a single uniform material layer 610. For purposes of illustration, enlarged portion 620 of layer 610 is shown. Enlarged portion 620 is seen to have inner surface 622 and outer surface 624, where inner surface 622 comprises part of the inner most surface of upper 602 and outer surface 624 comprises part of the outer most surface of upper 602.

In at least some embodiments, layer 610 of upper 602 has a substantial thickness, where substantial here indicates a thickness greater than the thickness of conventional upper materials such as woven and/or non-woven fabrics. In some embodiments, layer 610 could have a thickness greater than 0.5 mm. In other embodiments, layer 610 could have a thickness approximately in the range between 0.5 mm and 3 mm. In still other embodiments, layer 610 could have a thickness that is greater than 3 mm.

Embodiments may be comprised of various different kinds of materials. Embodiments comprised of a single layer construction could be made with at least one of the following materials: low-density foam, high-density foam, thermoplastic polyurethane, ethylene-vinyl acetate, phylon, as well as possibly other kinds of polymers or other materials.

Figure 11:
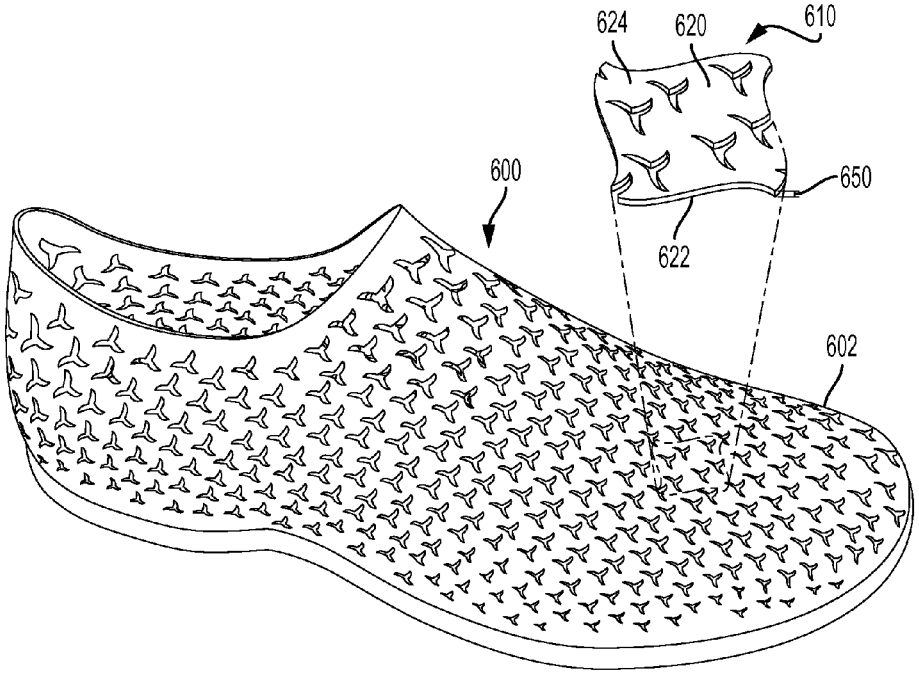
FIG. 11 is a schematic view of an embodiment of an article of footwear with an auxetic upper comprised of a single layer of material.
Figure 12:
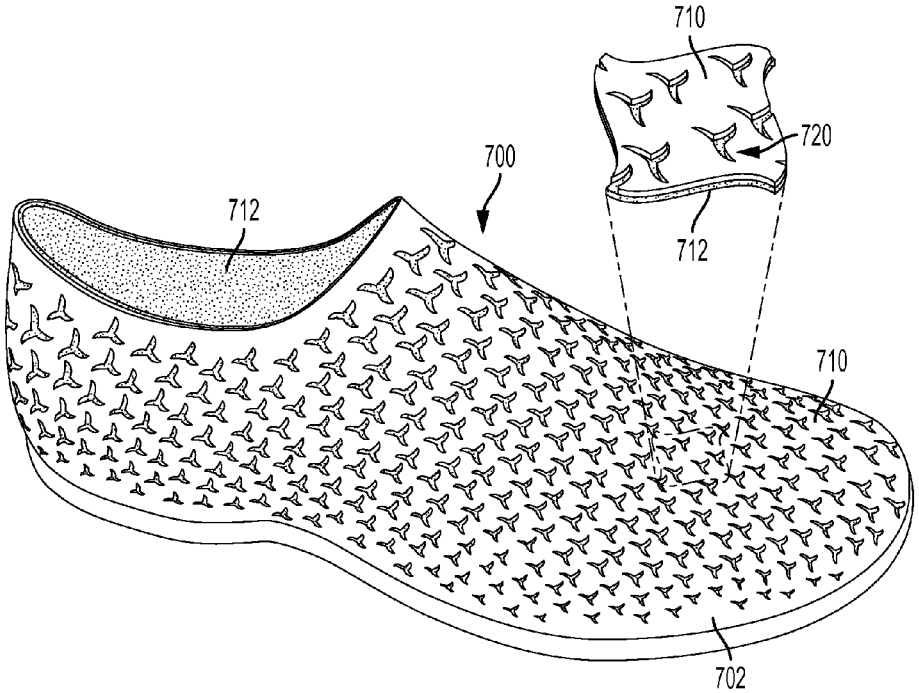
FIG. 12 is a schematic view of an embodiment of an article of footwear with an auxetic upper comprised of two layers of material.

In contrast to the embodiment of FIG. 11, FIG. 12 illustrates an isometric view of article 700 with a multilayered construction. As shown in FIG. 12, article 700 includes upper 702 with outer layer 710 and inner layer 712. In the multilayer configuration, an inner layer and an outer layer could have different materials and/or material properties. In some embodiments, inner layer 712 could be a textile layer. In some cases, inner layer 712 could be a textile layer with high elasticity or stretch. For example, in at least one embodiment, inner layer 712 may comprise an elastic layer that returns to a neutral state when stretched, while outer layer 710 may not be elastic. Moreover, outer layer 710 is seen to include auxetically arranged openings 720, while inner layer 712 is continuous without any openings. Thus, outer layer 710 may expand auxetically under tension and the elastic properties of inner layer 710 may act to return upper 702 to a neutral state (and size) once the tension has been released.

Embodiments comprised of two or more layers could include layers comprising any of the following materials: low-density foam, high-density foam, thermoplastic polyurethane, ethylene-vinyl acetate, phylon, as well as possibly other kinds of polymers or other materials. Still other materials include woven and non-woven fabrics, leather, synthetic leather, as well as other kinds of materials. In one embodiment, an inner layer could comprise an elastic woven material (e.g., nylon) and an outer layer could comprise a fabric layer, where the woven layer is free of openings and the outer layer includes auxetic openings.

Figure 13:
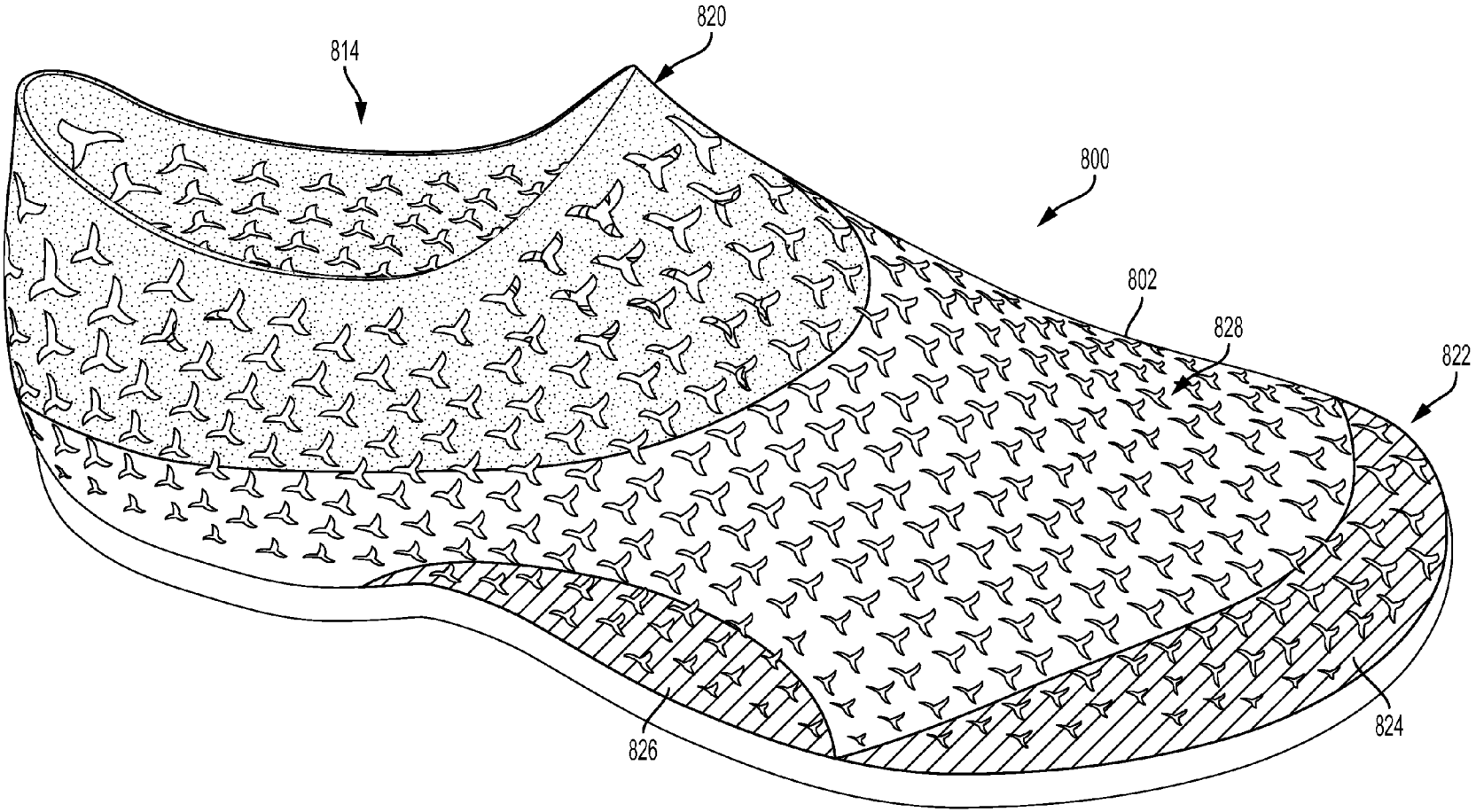
FIG. 13 is a schematic view of an embodiment of an article of footwear with an auxetic upper comprised of regions made of different materials.
Figure 14:
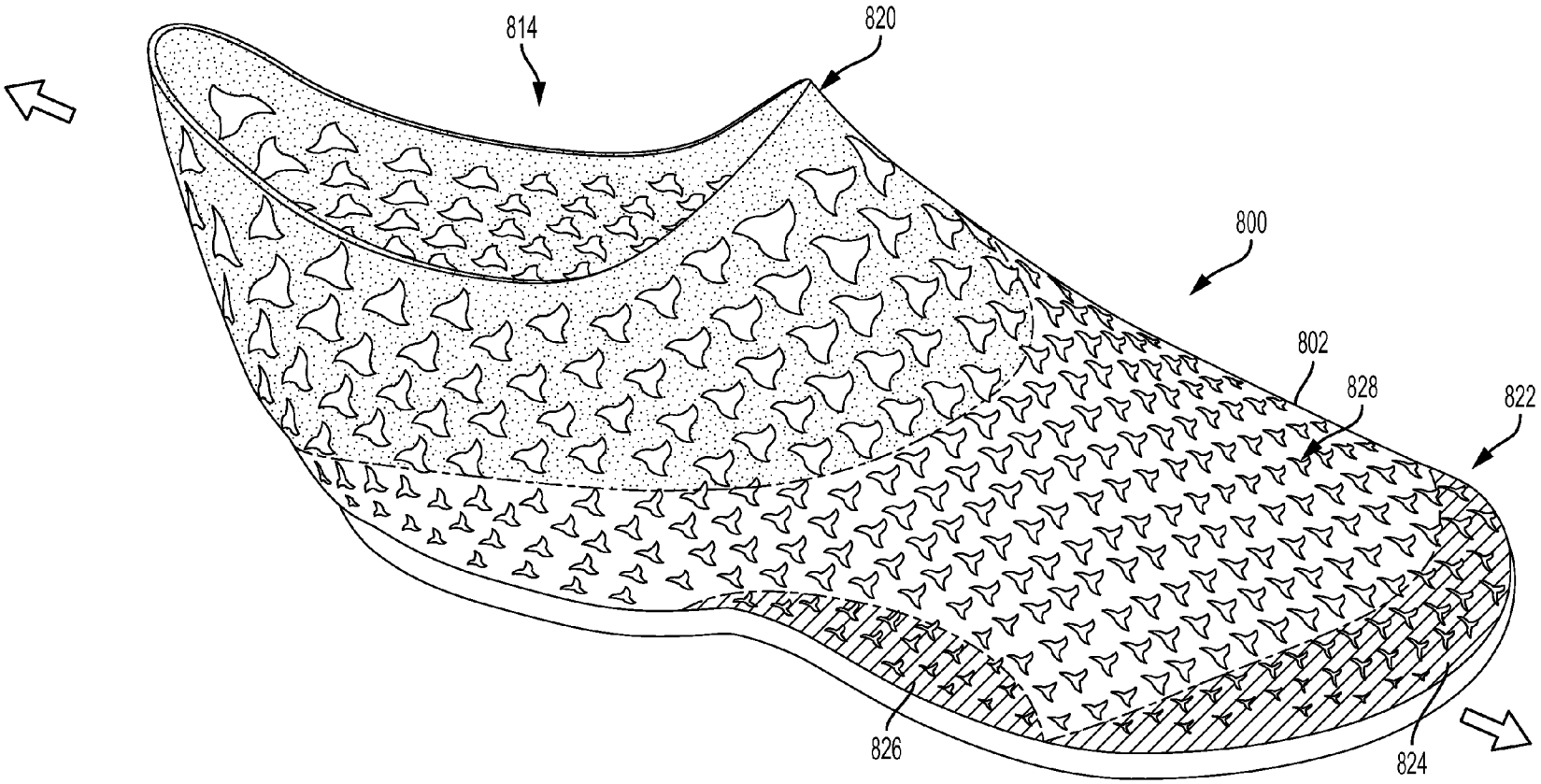
FIG. 14 is a schematic view of the article of footwear of FIG. 13 undergoing stretching.

FIGS. 13 and 14 illustrate schematic isometric views of another embodiment of article 800 with an auxetic upper 802. In this example, upper 802 includes regions comprised of distinct materials. Specifically, as seen in FIGS. 13-14, upper 802 is comprised of first material region 820, which surrounds opening 814, second material region 822, which includes forefoot edge portion 824 and arch portion 826, as well as third material region 828 that extends throughout the remaining portions of upper 802.

In the embodiment of FIGS. 13-14, first material region 820 is comprised of a first material, and second material region 822 is comprised of a second material, and third material region 828 is comprised of a third material. In some cases, the first material is different than the second material and the third material. Additionally, the second material is different from the third material. For example, in one embodiment, the first material could be more elastic than the second material and than the third material. Additionally, the second material could be more elastic than the third material. It may be appreciated that the elasticity of these materials is distinct from the degree of flexibility of each region, which is due to a combination of the elasticity (or flexibility) of the base material (i.e., of the "upper portions" between openings) and of the flexibility imparted by the auxetic configuration (i.e., the flexibility imparted by the openings having an auxetic configuration).

In different embodiments, the first, second, and third materials could comprise any materials and/or combinations of materials that impart the desired degree of elasticity for each region. In some embodiments, the first material comprising first material region 820 could be an elastic fabric, such as nylon or neoprene. In some embodiments, the second material comprising second material region 822 could comprise a foam layer. In some embodiments, the third material comprising third material region 828 could comprise a dense foam layer (i.e., denser than a foam comprising the second material) and/or a hard rubber.

It may be appreciated that providing different-sized holes in different material regions may allow the stretch properties of the upper to be tuned. Specifically, the stretch of the upper in different regions may be tuned to enhance the fit and support of the upper. By coupling and incorporating large auxetic openings into regions of highly elastic material, those regions may be capable of achieving significantly greater stretch than configurations where smaller openings are used or the underlying material has less elasticity.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. An upper for an article of footwear, comprising:

a first region and a second region of the upper, wherein the second region is different from the first region;

a plurality of openings extending through a portion of a thickness of the upper, the plurality of openings arranged to provide the upper with an auxetic property, the plurality of openings including:

a first opening provided in the first region, the first opening having a first perimeter length;

a second opening provided in the second region, the second opening having a second perimeter length that is greater than the first perimeter length; and an intermediate set of openings disposed between the first opening and the second opening; and wherein the perimeter length of each of the plurality of openings progressively increases from the first perimeter length of the first opening to the second perimeter length of the second opening across the intermediate set of openings.

2. The upper according to claim 1, wherein the auxetic property is a negative Poisson's ratio, such that if a portion of the upper is tensioned in a first direction, that portion expands from a neutral state to an expanded state both in the first direction and in a second direction that is orthogonal to the first direction.

3. The upper according to claim 2, wherein the second region is characterized by a greater expansion in the second direction than that of the first region when exposed to a similar tension.

4. The upper according to claim 1, wherein the first opening has a first opening boundary that includes:

a first vertex, a second vertex, a third vertex, a fourth vertex, a fifth vertex, and a sixth vertex;

a first edge extending from the first vertex to the second vertex;

a second edge extending from the second vertex to the third vertex;

a third edge extending from the third vertex to the fourth vertex;

a fourth edge extending from the fourth vertex to the fifth vertex;

a fifth edge extending from the fifth vertex to the sixth vertex; and a sixth edge extending from the sixth vertex to the first vertex.

5. The upper according to claim 4, wherein when in an undeformed state:

the first vertex has a corresponding first interior vertex angle that is greater than 180 degrees;

the second vertex has a corresponding second interior vertex angle that is less than 90 degrees;

the third vertex has a corresponding third interior vertex angle that is greater than 180 degrees;

the fourth vertex has a corresponding fourth interior vertex angle that is less than 90 degrees;

the fifth vertex has a corresponding fifth interior vertex angle that is greater than 180 degrees; and the sixth vertex has a corresponding sixth interior vertex angle that is less than 90 degrees.

6. The upper according to claim 4, wherein at least one of the first edge, the second edge, the third edge, the fourth edge, the fifth edge, and the sixth edge are curved.

7. The upper according to claim 1, wherein the first region is adjacent a throat opening of the upper and the second region is part of a forefoot portion of the upper.

8. The upper according to claim 1, wherein the first region is adjacent a throat opening of the upper and the second region is part of an arch portion of the upper.

9. The upper according to claim 1, wherein the upper is made of two or more layers.

10. The upper according to claim 1, wherein the second region is more proximate to a throat opening of the upper than is the first region.

* * * * *